US006434792B1

(12) United States Patent
Williamson

(10) Patent No.: US 6,434,792 B1
(45) Date of Patent: Aug. 20, 2002

(54) HINGE

(75) Inventor: Hugh Williamson, Lancaster, OH (US)

(73) Assignee: Universal Metal Products, Inc., Wickliffe, OH (US)

( * ) Notice: Subject to any disclaimer, the term of this patent is extended or adjusted under 35 U.S.C. 154(b) by 0 days.

(21) Appl. No.: 09/495,021

(22) Filed: Jan. 31, 2000

(51) Int. Cl.[7] ..... E05D 5/06

(52) U.S. Cl. ..... 16/389; 16/387; 16/268; 16/262

(58) Field of Search ..... 16/389, 386, 387, 16/254, 229, 230, 262, 268, 265, 270, 317; 312/401, 405

(56) References Cited

U.S. PATENT DOCUMENTS 2,200,440 A * 5/1940 Atwood ..... 16/224
3,977,042 A * 8/1976 Lautenschlager ..... 16/238
4,090,274 A * 5/1978 Bourgeois ..... 16/317
4,485,544 A * 12/1984 Van Ryswyk ..... 16/386
4,774,740 A 10/1988 Gidseg ..... 16/344
5,215,367 A * 6/1993 Montuoro et al. ..... 312/401
5,265,954 A 11/1993 Keil ..... 312/405
5,369,842 A * 12/1994 Beatty ..... 16/317
5,408,725 A * 4/1995 Wolanin ..... 16/239
5,497,534 A 3/1996 Caruso ..... 16/288
5,896,619 A 4/1999 Koopman ..... 16/50

* cited by examiner

*Primary Examiner*—Chuck Y. Mah
(74) *Attorney, Agent, or Firm*—Emerson & Skeriotis; Roger D. Emerson; Daniel A. Thomson

(57) ABSTRACT

A new and improved hinge for use with a refrigerator door. The inventive hinge is a drawn hinge, created by the drawing process. The inventive hinge includes first and second flanges, a pin, and a pin arm. The flanges on each side allow use of a thinner piece of metal in creating a hinge, while retaining the strength of a thicker piece of metal. The pin arm is extended in order to prevent pinching when opening and closing a refrigerator door.

9 Claims, 5 Drawing Sheets

HINGE

BACKGROUND OF THE INVENTION

A. Field of the Invention

This invention relates to the art of hinges, and more particularly to the art of drawn hinges for refrigerator doors.

B. Description of the Related Art

The present invention provides a new and improved hinge for refrigerator doors. The new hinge uses a drawing press to create the hinge, so that the hinge can be made of a thinner piece of metal while still retaining the strength of the thicker prior art. Also, the inventive hinge has a pin arm that extends further away from the center of the hinge than the prior art pin arm in order to prevent pinching when opening and closing the doors.

A known door hinge is disclosed in U.S. Pat. No. 5,896,619 to Koopman. The Koopman patent discloses a door hinge and closer mechanism, which includes a hinge unit, and a closer unit that are integral and a hinge plate of a hinge unit serves as a support for components of the closure unit. However, the Koopman patent does not disclose a drawn hinge, or any others features of the current invention.

Another known door hinge is disclosed in U.S. Pat. No. 4,774,740 to Gidseg et al. The Gidseg patent discloses a hinge for rotationally mounting a barrier member to structural means, which comprises first hinge mounting means having means for attachment thereof to the structural means. However, the Gidseg patent does not disclose a drawn hinge as described in the current invention.

Another known hinge is disclosed in U.S. Pat. No. 5,497,534 to Caruso. The Caruso patent discloses a refrigerator door hinge assembly including a refrigerator bracket and a door bracket, a first link pivotally connected to refrigerator bracket and the door bracket, a second link pivotally connected to the refrigerator bracket and the door bracket, the distance between the pivot connections or the second link being greater than the distance between the pivot connections of the first link, each of the first and second links being located in different but parallel plains and include a surface which engages an inner wall of the door bracket when the door is in a closed position thereby maintaining the parallel relation between the door and the refrigerator. However, the Caruso patent does not disclose a drawn hinge as disclosed in the current invention.

Another known hinge assembly is disclosed in U.S. Pat. No. 5,265,954 to Keil. The Keil patent discloses an anti-pinch hinge assembly including a hinge butt mounted to a refrigerator cabinet having a generally planer section extending perpendicular to and outwardly from the cabinet. However, the Keil patent does not disclose a drawn hinge.

The drawing process, in order to create a shaped product from a flat piece of metal, is well known in the art, and will not be described herein. However, the use of the drawing process to create a hinge is not known in the art.

This invention is simple in design, effective in use, and overcomes the full growing difficulties and others while providing better and more advantageous overall results.

DEFINITIONS

Drawing process—to spread or elongate metal by hammering or pulling through dies; also, to shape "as plastic" by stretching or by pulling through dies.

Hinge—a jointed or flexible device on which a door, lid, or other swinging part turns.

SUMMARY OF THE INVENTION

In accordance with the present invention, a hinge for use with an associated refrigerator door includes a pin, a pin arm, the pin extending substantially 90° with respect to the pin arm, receiving means for receiving connecting means for connecting the hinge to the associated refrigerator door, a first flange, a second flange, a first side, a second side, the first and second sides being substantially 90° with respect to each other, the first and second flanges extending downwardly at substantially 90° with respect to the first and second sides, a first length, and a second length, the first length being greater than the second length.

In accordance with still another aspect of the present invention, a method for producing a thinner, more effective hinge, includes the steps of providing a substantially flat piece of metal, providing a hinge-shaped mold, the mold having first and second sides, the sides being substantially 90° with respect to each other, protrusions, the protrusions creating the receiving means in the hinge, and first and second lengths, the first length being greater than the second length, providing a drawing press, drawing the hinge, inserting a pin into a pin arm, removing any excess metal from the hinge.

One advantage of the present invention is that the hinge can be made from a thinner piece of metal due to the drawing process.

Another advantage of the present invention is that the strength of the thinner hinge is the same as the thicker prior art hinges.

Still another advantage of the present invention is that the pin arm is extended in order to prevent pinching when the door is opened or closed.

Yet another advantage of the present invention is that the drawn hinge does not need to be reinforced with an extra piece of metal.

Still other benefits and advantages of the invention will become apparent to those skilled in the art upon a reading and understanding of the following detailed specification.

BRIEF DESCRIPTION OF DRAWINGS

The invention may take physical form in certain parts and arrangement of parts. Multiple embodiments of these parts will be described in detail in the specification and illustrated in the accompanying drawings, which form a part hereof and wherein.

DESCRIPTION OF THE INVENTION

Figure 1:
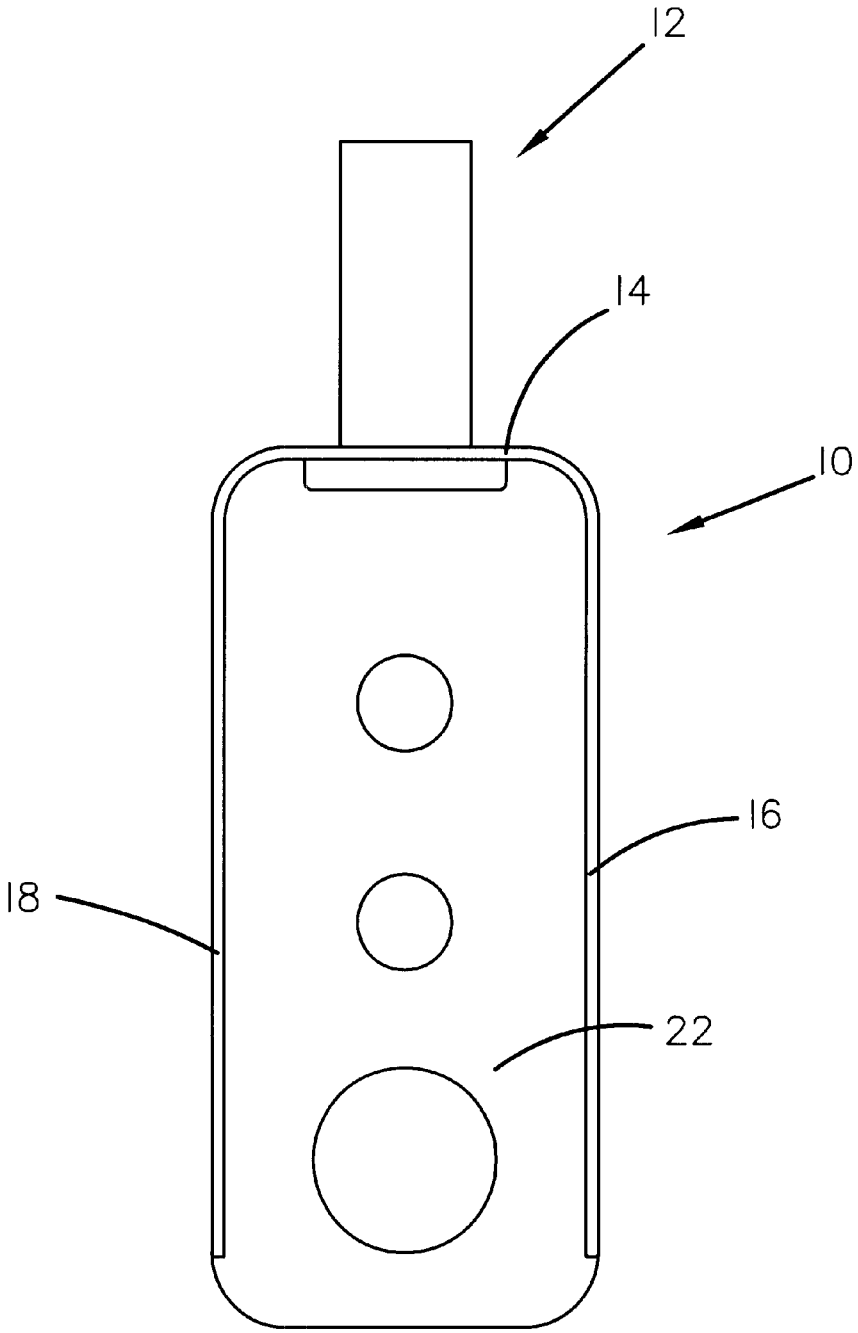
FIG. 1 is a front view of the inventive hinge, showing the flanges, the pin arm, and the pin.

With reference now to FIG. 1, a front view of inventive hinge 10 is shown, including a pin arm 14, first and second flanges 16, 18, second side 22, and fifth, sixth, and seventh lengths $L_5$, $L_6$, $L_7$. A pin 12 extends upwardly from the pin arm 14, substantially at a 90-degree angle. The pin arm 14 is a continuous piece of the hinge 10, and continues on into the first side 20, which continues downward into the second side 22, as shown in FIG. 1. The connection of the pin arm 14, the first side 20, and the second side 22 approximately creates a L-shape. The fifth length $L_5$ defines the distance between the center of first opening 26 and the center of third opening 30. And in this embodiment the fifth length $L_5$ is 32.26 millimeters. The sixth length $L_6$ is the distance between the top of the pin arm 14 and the center of the third opening 30, and in this embodiment the sixth length $L_6$ is 48.39 millimeters. The seventh length $L_7$ is the distance between the center of second opening 28 and the center of the third opening 30, and in this embodiment is 16.13 millimeters. Openings 26, 28 are used to connect the hinge 10 to the refrigerator cabinet (not shown). The third opening 30 is used as an access to other structures, but is not a requirement for this invention.

Figure 2:
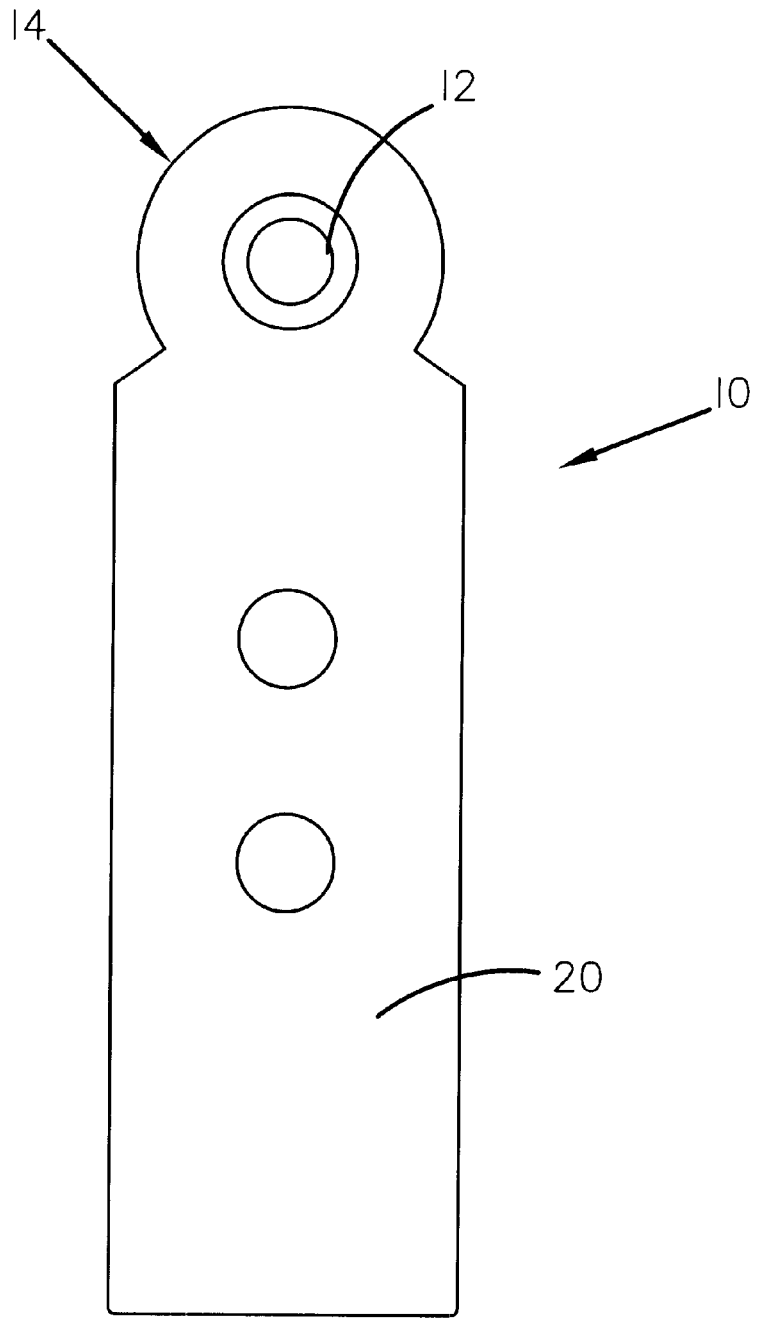
FIG. 2 is a top view of the inventive hinge, showing the pin arm the pin, and the first side.

With reference to FIG. 2, a top view of the inventive hinge 10 is shown. FIG. 2 shows the hinge 10, including the pin arm 14, the pin 12, fourth opening 32, fifth opening 34, first side 20, third width $W_3$, third angle $\alpha_3$, and eighth and ninth lengths $L_8$, $L_9$. The eighth length $L_8$ is defined by the distance between the center of the pin 12 and the center of the fourth opening 32 and in this embodiment is 18.24 millimeters. The ninth length $L_9$ is defined by the distance between the center of the pin 12 and the fifth opening 34, and in this embodiment is 38.1 millimeters. The third angle $\alpha_3$ is defined as shown in FIG. 2, and in this embodiment is 25°. The fourth opening 32 is used for a cam-closer attachment (not shown) and the fifth opening 34 is used for an electrical wire routing attachment. Neither the fourth nor the fifth openings 32, 34 is required for this invention. The hinge 10 can be connected to the refrigerator door using any connecting means chosen using sound engineering judgment.

Figure 3:
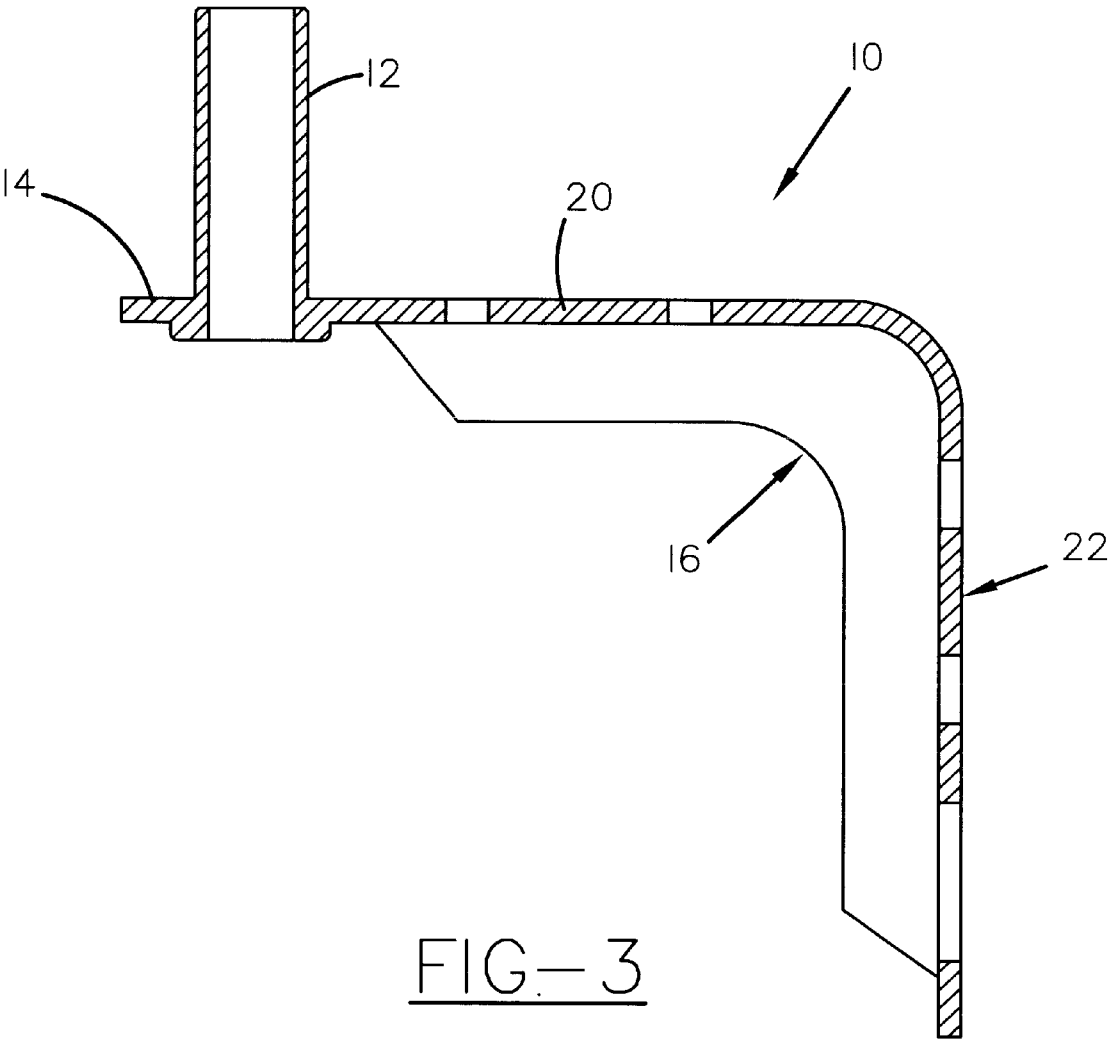
FIG. 3 is a side view of the inventive hinge, showing the first flange, the first and second sides, the pin arm, and the pin.

With reference now to FIG. 3, the inventive hinge 10 is shown including the pin 12, the pin arm 14, first flange 16, an elbow 36, the second side 22, first width $W_1$, fourth width $W_4$, first angle $\alpha_1$, second angle $\alpha_2$, and first, second, and third lengths $L_1$, $L_2$, $L_3$. FIG. 3 shows the continuous line of the pin arm 14, the first side 20, and the second side 22. By "continuous line" it is meant that the first side 20, the second side 22, and the elbow 36 form an L-shape. The first side 20 ends at one end of the elbow 36, and the second side 22 begins at the other side of the elbow 36, as is shown in FIG. 3. The first flange 16 extends outwardly from the first and second sides 20, 22 at substantially 90°. The first flange 16, as well as the second flange 18, is created by the drawing process. When the die (not shown) is pressed against the raw piece of metal (not shown) the metal forms around the die, creating the flanges 16, 18.

The first length $L_1$ is defined by the distance between the two ends of the first side 20, and in this embodiment is 53.8 millimeters. The fourth width $W_4$ is defined by the distance of the two sides of the pin 12, and in this embodiment is 13.5 millimeters. The third $L_3$ length is defined at a distance between the top and bottom of the pin 12, and in this embodiment is 25.1 millimeters. The first width $W_1$ is defined as the width of the hinge 10, and in this embodiment is 3 millimeters. The first angle $\alpha_1$, as shown in FIG. 3, is 40° and the second angle $\alpha_2$, as shown in FIG. 3, is 30°.

Figure 4:
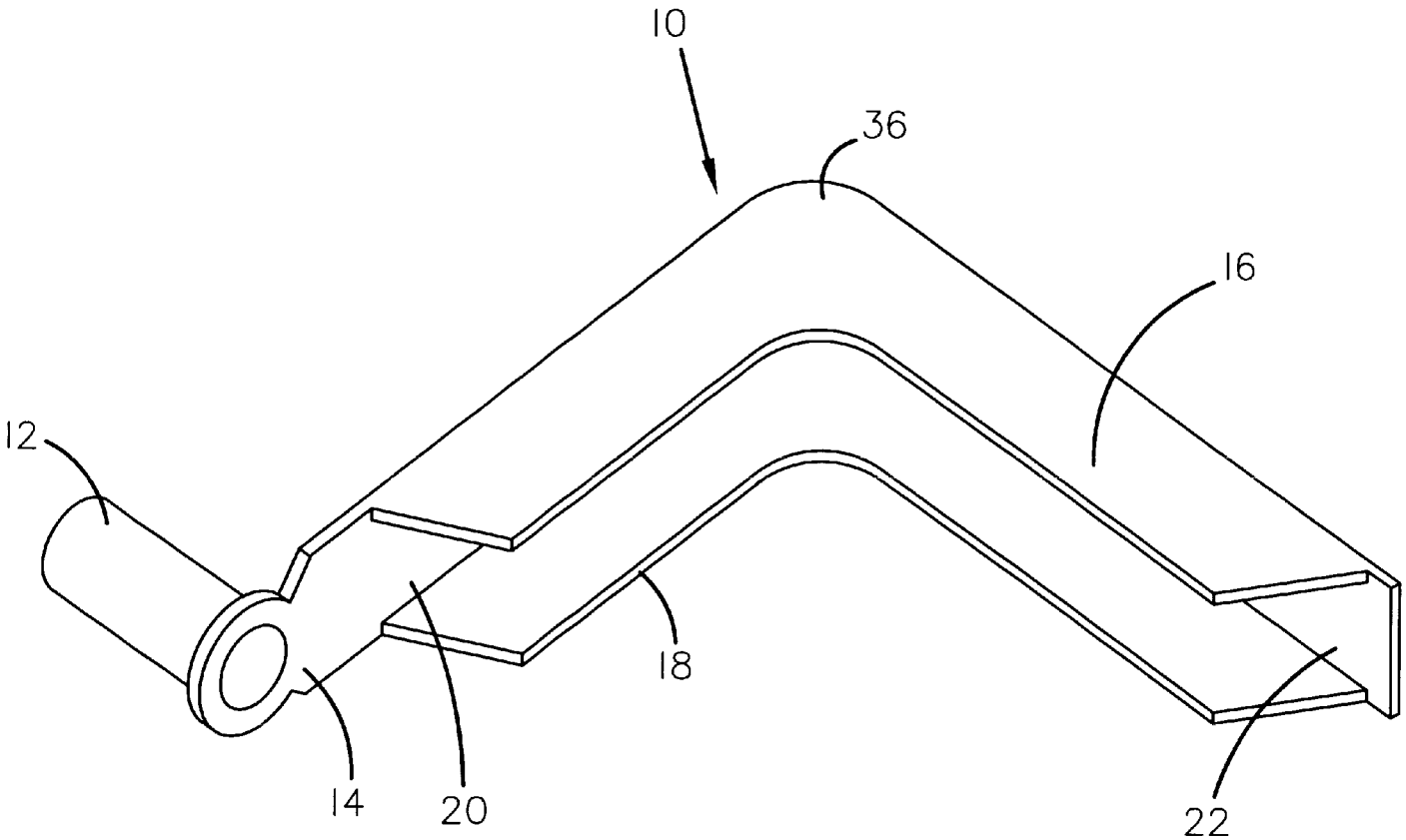
FIG. 4 is a perspective view of the inventive hinge, showing the first and second sides, the flanges, the pin arm, and the pin; and, FIG. 5 is a the side view of the prior art hinge, showing a reinforcement and the width of the art hinge.

With reference now to FIG. 4, the inventive hinge 10 is shown including the pin 12, the pin arm 14, the first and second sides 20, 22, and first and second flanges 16, 18. FIG. 4 shows a perspective view of the inventive hinge 10, showing the concave nature of the hinge 10. This concave nature, wherein the flanges 16, 18 extend downwardly from the first and second sides 20, 22, as a result of the drawing process. The flanges 16, 18 allow the use of a thinner piece of metal in creating the hinge 10, while still retaining the strength of a thicker piece of metal.

Figure 5:
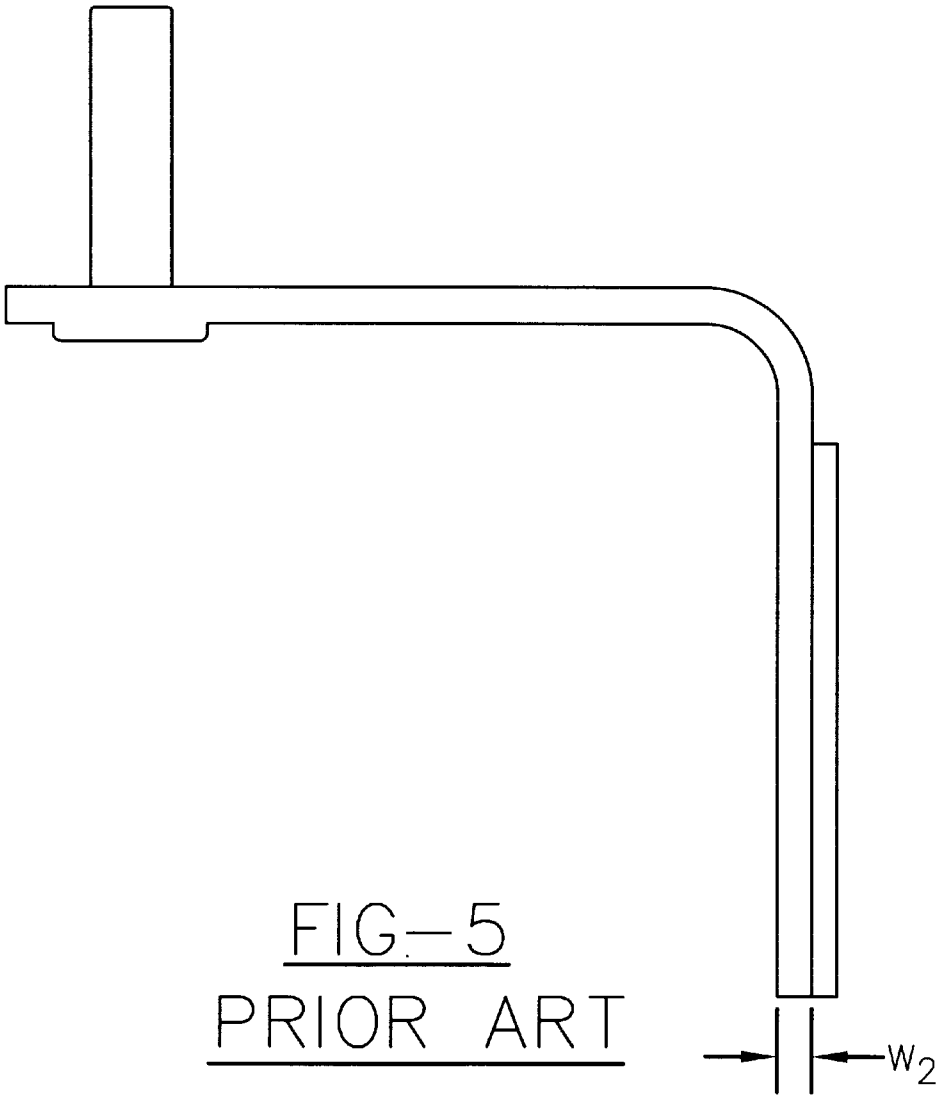
FIG-5 PRIOR ART

With reference now to FIG. 5, the prior art hinge is shown, including a reinforcement 24 and a second width $W_2$. The reinforcement 24 is necessary in order to give the prior art hinge the necessary strength for its intended use. The second width $W_2$ is substantially greater than the first width $W_1$ as shown in FIG. 4. It can also be seen from FIGS. 3 and 5, that the pin arm 14 of the inventive hinge 10 is extending further than that of the prior art hinge. The fact that the pin arm 14 is further away from the elbow 36 helps prevent pinching when opening and closing the refrigerator door (not shown).

It is to be understood that the L-shape shown for the inventive hinge 10 is merely one embodiment of the hinge 10, and is not intended to limit the invention in any way. Any shape of hinge may used as long as chosen using sound engineering judgment. Also, the measurements recorded in this specification are merely measurements for this embodiment and are not intended to limit the invention in any manner. The invention is also not limited to metal hinges, but the hinge can be made of any material that can be used with the drawing process. The inventive hinge 10 is also not limited to refrigerator doors, but can be any hinge as defined in the "Definitions" section.

The invention has been described with reference to the preferred embodiment. Obviously, modifications and alterations will occur to others upon a reading and understanding of the specification. It is intended by applicant to include all such modifications and alterations insofar as they come within the scope of the appended claims or the equivalents thereof.

Having thus described the invention, it is now claimed.

What is claimed is:

1. A metal hinge for use with an associated refrigerator door, the hinge comprising:

a top;

a back, wherein the top and back form one continuous piece, the top and back being substantially 90° with respect to each other;

a first flange;

a second flange, the first and second flanges extending downwardly from the top and back at substantially 90° with respect to the top and back, each flange forming a substantially 90° angle, wherein the top, back, and flanges form one continuous piece;

a pin;

a pin arm, the pin arm forming a continuous substantially planar piece with the top, the pin extending upwardly substantially 90° with respect to the pin arm;

the top having a first length;

the back having a second length, the first length being greater than the second length; and, receiving means for receiving associated connecting means for connecting the hinge to the associated refrigerator door, the receiving means being located in the back.

2. A hinge comprising:

a metal body, the body being substantially L-shaped, the body having a top and a back;

a first flange;

a second flange, the flanges extending from the body at substantially 90°, each flange forming a substantially 90° angle, wherein the body and the flanges form one continuous piece; and, a pin, the pin extending upwardly substantially 90° with respect to the top.

3. The hinge of claim 2, wherein the metal body further comprises:

said top having a first length;

said back having a second length, the top and back forming the body of the hinge, the first length being greater than the second length.

4. The hinge of claim 3, wherein the top and back are substantially 90° with respect to each other.

5. The hinge of claim 4, wherein the flanges extend downwardly at substantially 90° with respect to the top and back.

6. The hinge of claim 5, wherein the hinge further comprises:

a pin arm, the pin arm forming a continuous piece with the top.

7. The hinge of claim 6, wherein the hinge further comprises receiving means for receiving connecting means for connecting the hinge to an associated door, the receiving means being located in the back.

8. The hinge of claim 3, wherein the body further comprises:

a width, wherein the ratio of the first length to the width is 18 to 1 or greater.

9. The hinge of claim wherein the first length is 54 millimeters and the width is approximately 3 millimeters.

* * * * *